US005806207A

United States Patent [19]

Merrigan

[11] Patent Number: 5,806,207

[45] Date of Patent: Sep. 15, 1998

[54] STAND AND HEAT RECYCLER FOR LAUNDRY DRYER

[76] Inventor: Melcena K. Merrigan, P.O. Box 585, Lennox, S. Dak. 57039

[21] Appl. No.: 995,630

[22] Filed: Dec. 22, 1997

[51] Int. Cl.[6] ..... F26B 11/02

[52] U.S. Cl. ..... 34/603; 34/86; 34/151

[58] Field of Search ..... 34/86, 90, 91, 34/108, 109, 201, 219, 225, 235, 595, 603

[56] References Cited

U.S. PATENT DOCUMENTS

| | | | |
|---|---|---|---|
| 4,028,817 | 6/1977 | Winstel | 34/86 |
| 4,207,056 | 6/1980 | Bowley | 432/3 |
| 4,819,341 | 4/1989 | Gayso | 34/86 |
| 4,969,276 | 11/1990 | Walsh | 34/90 |
| 5,666,739 | 9/1997 | Krueger | 34/86 |

*Primary Examiner*—Henry A. Bennett
*Assistant Examiner*—Pamela A. Wilson

[57] ABSTRACT

A heat salvaging device for a household laundry drier. The device may serve both as a stand for the drier and a device for salvaging waste heat from the drying process. The heat salvaging operation is controlled by controlling a single vent in the stand.

8 Claims, 1 Drawing Sheet

STAND AND HEAT RECYCLER FOR LAUNDRY DRYER

BACKGROUND AND SUMMARY OF THE INVENTION

This invention pertains to a device for the recovery of waste heat from household laundry driers. The device is also useful as a stand for elevating the entry to the drier to a level where the laundered goods can be placed in the drier without stooping or bending over, thus resulting in easier loading of the drier.

Most household laundry driers are loaded from the front and therefore, if the drier is set directly on the floor, loading the machine requires bending over. For most people such bending is inconvenient, and for some it may be painful. The device of this invention relieves that need to stoop or bend.

Heat either from the burning of gas or from electric power is ordinarily used to assist in the drying. Not all of this heat is used in the process, and the excess is commonly wasted by sending the exhaust air to the exterior of the building in which the drier is housed. In most times, that seems reasonable. However, when the ambient air is cold the wasted heat is completely wasted while other sources are relied on to heat the room.

The device of this invention also provides for convenient use of the heat which might otherwise be wasted. This is accomplished readily by opening or closing a single vent which routes the heated air either into or out of the room.

DESCRIPTION

Figure 1:
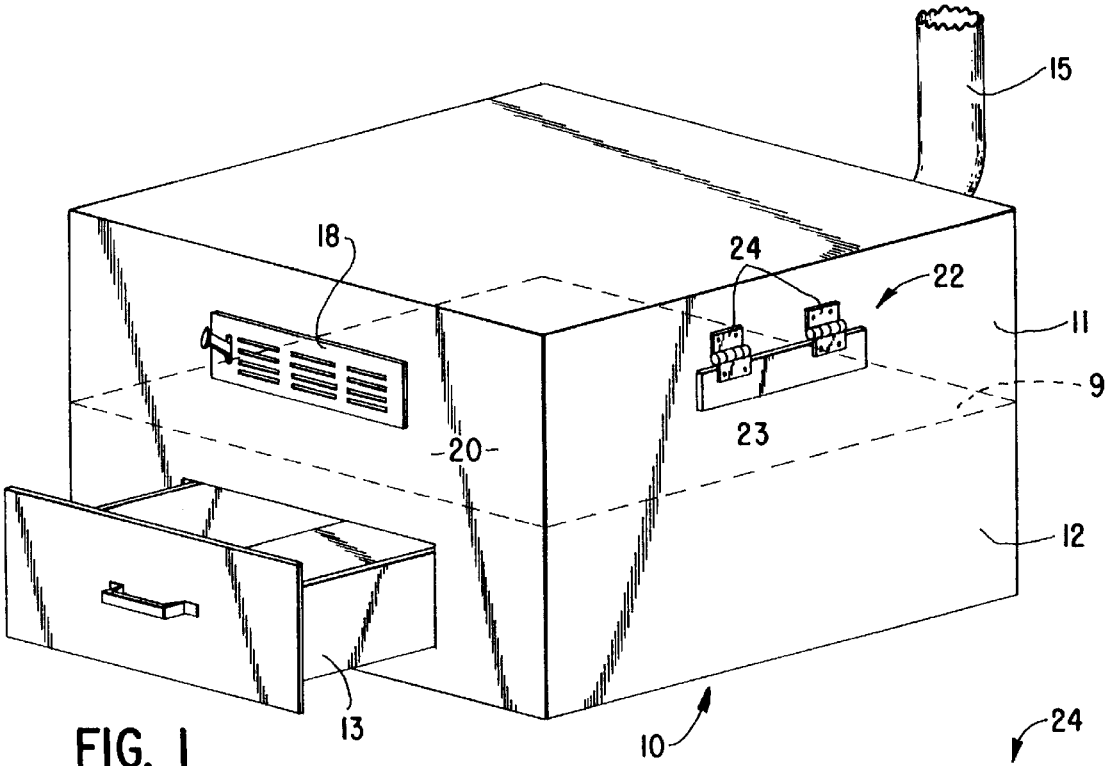
FIG. 1 is a perspective view of the stand device from the front showing its auxiliary drier open.
Figure 3:
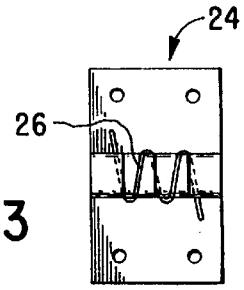
FIG. 3 is a detailed elevational view of a hinge on the second outlet.

Briefly the invention comprises a stand on which a household laundry drier may be set. The stand includes provisions for returning heated air from the drier either to the outside air or to the room in which the drier is set, whichever is desired. A simple and convenient system is used to provide for the selection.

More specifically and referring to the drawings, the invention is embodied in a single cabinet-like stand 10. This stand should be approximately 10 to 15 inches high so that the entrance to the drier will be at a level convenient for the user to load without stooping. This feature will be particularly useful with the top-loading household washing machines where the unloading of the washer will be done at about the same level as the loading of the drier.

With a stand of about 10 or more inches in height, it will be possible to use two compartments in the stand divided by a divider 9. The upper compartment 11 is the compartment which handles the waste air for the drier (not shown) while the lower compartment 12 may be used for storage and be built to provide for a drawer 13 or the like.

Figure 2:
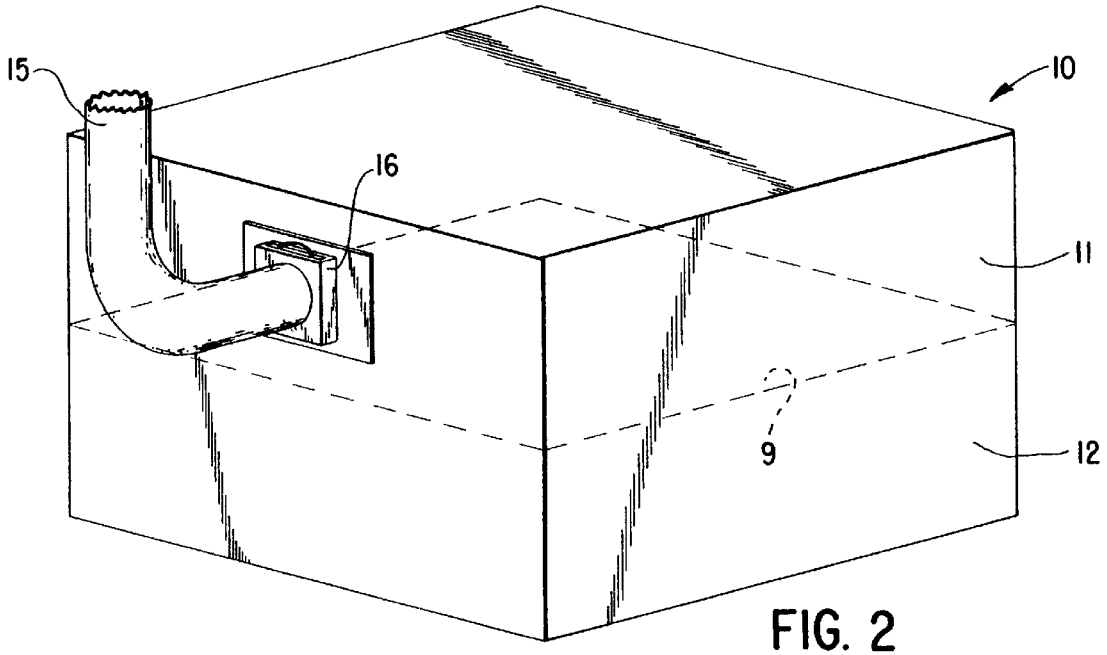
FIG. 2 is a perspective view from the rear of the stand.

The upper compartment 11 is built with an inlet for the exhaust hose 15 from the drier. This hose is connected through a lint trap 16 (FIG. 2) and thence is opened into the upper compartment 11.

The compartment 11 is simply an open chamber, but it has two outlets. The first outlet 18 may be at the front of the stand or may at any wall having a free opening into the room in which the drier is set. Because of the possibility of a variety of settings, the front wall 20 would be the one that would be most assured of being free. Therefore, the front wall is the preferred location for the inside vent outlet 18. This outlet includes a control 21 adapted to open or close the vent to allow the air in the upper compartment to escape readily into the room or to be substantially prevented from entry into the room.

The second outlet 22 is built into the side of the stand which will be placed against an exterior wall of the laundry room. If necessary, a duct may lead from the outlet to and through that wall. For purposes of illustration and ease of explanation, no ducting is shown. Such ducting is well within the abilities of one skilled in the art of installation of larger appliances such as driers.

The outlet itself comprises a flap 23 which may be made of wood or other material such as plastic. Hinges 24 at the top of the flap 23 allow it to close by gravitational force alone. If desired, light springs 26 in the hinges might be desirable to hold the flap 23 in its normally closed position.

In operation, the stand 10 is placed so that the second outlet 22 is adjacent to an exterior wall. If necessary, proper venting of that outlet through that wall should be provided. The drier is placed on the stand, and the exhaust hose 15 is run from the drier to the lint filter 16 so that heated air for the drier will exhaust into the chamber 11.

The above description will cover most models of drier. In some drier devices, the vent exits directly from the bottom of the drier. In those models, a lint trap similar to the filter 16 may be inserted between the bottom of the drier and a matching opening in the top of the upper chamber 11 so that the discharge from the drier bottom exhausts through the filter directly into the upper chamber.

So long as the drier is not in use, the flap 23 will be closed by the force of gravity and the force of the opening 26. This provides entry into the chamber 11 of air at an undesirable temperature (too hot or too cold) from outside and also guards against the entrance of insects, mice, or the like.

When the device is in use, air will be impelled by a fan in the drier throughout the hose 15 into the chamber 11. If it is desired to use this warmed air to heat the room, the grill on the first outlet 18 can be opened, and the air from the drier will simply be exhausted from the chamber 11 into the laundry room. On the other hand, if such heating is not desired in the room, the grill 18 may be closed. Pressure in the chamber 17 will then build up until it overcomes the weight of the flap 23 and any springs 26 which might be used. The flap 23 will then open the second outlet 22 and the warmed air from the drier will be exhausted outside. Thus, by use of the stand, a convenient diversion device is available to raise the drier to a convenient level and to make possible alternate uses of the heated air from the drier.

I claim as my invention:

1. For use with a household laundry drier having a flexible exhaust hose, a stand comprising a structure with a box shape adapted to support said drier, said stand enclosing at least one open chamber, entrance means in said chamber for the attachment of said hose to duct exhaust air from said drier into said chamber.

2. The stand of claim 1 in which a lint trap is located in said entrance means between said hose and said chamber.

3. The stand of claim 1 in which said chamber is formed to provide alternate outlets for said exhaust air, said outlets being operable alternately to provide alternate routes for the discharge of said exhaust air.

4. The stand of claim 3 which said stand is for use in a laundry room having an exterior wall, said alternate outlets including a first outlet placed in said stand to exhaust into said room and a second outlet placed adjacent said exterior wall in position to exhaust through said exterior wall.

5. The stand of claim 4 in which said first outlet includes a closeable grill by which the flow of exhaust air will be substantially prevented.

6. The stand of claim 5 which said second outlet includes a closure flap adapted to close said second outlet.

7. The stand of claim 6 in which said closure flap is hinged to be normally closed by the force of gravity, auxiliary springs connected to said flaps to provide added closing force, said force of gravity and the force of said springs being light enough to be overcome by pressure in said chamber when said first outlet is closed.

8. The stand of claim 1 in which said structure with a box shape is divided into an upper chamber and a lower chamber, said entrance means being formed in said upper chamber.

* * * * *